US009051818B2

(12) United States Patent
Meng

(10) Patent No.: US 9,051,818 B2
(45) Date of Patent: Jun. 9, 2015

(54) DUAL SUBSEA PRODUCTION CHOKES FOR HPHT WELL PRODUCTION

(75) Inventor: Weihong Meng, Katy, TX (US)

(73) Assignee: FLUOR TECHNOLOGIES CORPORATION, Aliso Viejo, CA (US)

( * ) Notice: Subject to any disclaimer, the term of this patent is extended or adjusted under 35 U.S.C. 154(b) by 1371 days.

(21) Appl. No.: 12/439,012

(22) PCT Filed: Oct. 4, 2007

(86) PCT No.: PCT/US2007/021489

§ 371 (c)(1),
(2), (4) Date: Sep. 30, 2009

(87) PCT Pub. No.: WO2008/045381

PCT Pub. Date: Apr. 17, 2008

(65) Prior Publication Data

US 2010/0006299 A1 Jan. 14, 2010

Related U.S. Application Data

(60) Provisional application No. 60/849,544, filed on Oct. 4, 2006.

(51) Int. Cl.

| | |
|---|---|
| ***E21B 7/12*** | (2006.01) |
| ***E21B 43/00*** | (2006.01) |
| ***E21B 43/013*** | (2006.01) |
| ***E21B 33/038*** | (2006.01) |
| ***E21B 34/04*** | (2006.01) |

(52) U.S. Cl.

CPC ..... *E21B 43/013* (2013.01); *E21B 33/038* (2013.01); *E21B 34/04* (2013.01)

(58) Field of Classification Search

USPC ..... 166/338, 344, 345, 367, 368, 250.15, 166/369, 370, 91.1

See application file for complete search history.

(56) References Cited

U.S. PATENT DOCUMENTS

| | | | | | |
|---|---|---|---|---|---|
| 2,316,383 | A | * | 4/1943 | Abercrombie | 166/91.1 |
| 3,163,224 | A | * | 12/1964 | Haeber et al. | 166/345 |
| 3,279,536 | A | * | 10/1966 | Wakefield, Jr. | 166/348 |
| 3,894,560 | A | * | 7/1975 | Baugh | 137/606 |
| 4,174,000 | A | * | 11/1979 | Milberger | 166/363 |
| 4,210,208 | A | | 7/1980 | Shanks | |
| 4,299,260 | A | * | 11/1981 | Jansen | 141/311 R |
| 4,589,493 | A | * | 5/1986 | Kelly et al. | 166/341 |
| 4,682,913 | A | * | 7/1987 | Shatto et al. | 405/169 |
| 4,938,450 | A | | 7/1990 | Tripp et al. | |

(Continued)

FOREIGN PATENT DOCUMENTS

| | | |
|---|---|---|
| EP | 0527619 | 6/1996 |
| WO | 99/47788 | 9/1999 |
| WO | 2007/074342 | 7/2007 |

*Primary Examiner* — James G Sayre
(74) *Attorney, Agent, or Firm* — Fish & Tsang, LLP

(57) ABSTRACT

Configurations and methods for subsea hydrocarbon production at high pressure wells are contemplated in which production control is achieved by implementing two choke valves in series between the wellhead and the riser. The first production choke reduces pressure from well pressure to a reduced pressure, while the second production choke further reduces the pressure from the reduced pressure to riser pressure. The first production choke is preferably coupled to the production tree, and the second production choke is coupled to production tree, a subsea pipeline-end device (e.g., PLET or PLEM), a well jumper, or a flowline jumper.

20 Claims, 1 Drawing Sheet

(56) References Cited

U.S. PATENT DOCUMENTS

| | | | | |
|---|---|---|---|---|
| 5,010,956 | A * | 4/1991 | Bednar | 166/344 |
| 5,018,703 | A | 5/1991 | Goode | |
| 5,687,763 | A | 11/1997 | Steinke | |
| 6,105,614 | A | 8/2000 | Bohaychuk et al. | |
| 6,371,208 | B1 | 4/2002 | Niorman et al. | |
| 6,701,958 | B2 | 3/2004 | Baumann | |
| 7,040,393 | B2 | 5/2006 | Adams et al. | |
| 7,093,661 | B2 * | 8/2006 | Olsen | 166/357 |
| 2004/0007392 | A1 | 1/2004 | Judge et al. | |
| 2007/0163774 | A1 | 7/2007 | Hosatte et al. | |

* cited by examiner

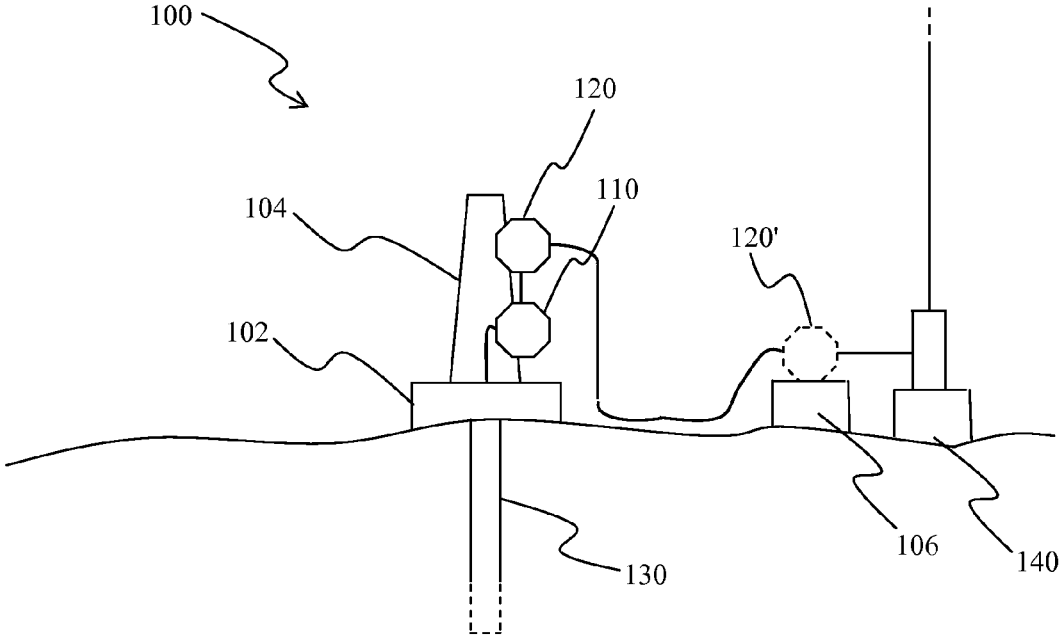
100
120
110
104
120'
102
106
140
130

DUAL SUBSEA PRODUCTION CHOKES FOR HPHT WELL PRODUCTION

This invention claims priority to our provisional patent application with the Ser. No. 60/849,544, which was filed Oct. 4, 2006.

FIELD OF THE INVENTION

The field of the invention is choke valves for deepwater well production, especially as it relates to choke valves for high-pressure (HP) oil and gas well production.

BACKGROUND OF THE INVENTION

Recent discoveries of high pressure oil and gas reserves in the Gulf of Mexico and the North Sea have presented a challenge to subsea production control as the initially encountered well pressure is very high but later expected to significantly drop over time.

Currently, pressure and flow rate control is achieved using a single subsea production choke mounted on a subsea production tree. However, as the excess pressure in HP wells may be as high as 5000 to 6000 psi across the production choke, rapid deterioration or even failure of the choke is likely due to the severe operating conditions at the choke trim. An exemplary subsea choke valve is described in U.S. Pat. No. 4,589,493, which is incorporated by reference herein, and improvements to alleviate at least some of the difficulties associated with product flow characteristics near the off position are shown in U.S. Pat. No. 6,701,958. As the production stream contains in addition to gas and crude oil also particulate matter, operation at relatively high pressure often severely reduces the lifetime of choke valves due to mechanical wear.

Wear resistance can be improved by using disk stacks in which multiple disks define a 3-dimensional tortuous path through which the high-pressure fluid is routed. Examples for such choke valves are disclosed in U.S. Pat. No. 4,938,450 and WO 2007/074342. While such choke valves significantly improve wear resistance and cavitation, several problems still remain. Among other things, large pressure differentials are often difficult to control with such valves. Alternatively, the high-pressure fluid may be fed through a series of concentric sleeves that define flow paths by inclusion of sleeve openings, wherein the sleeves can be rotated relative to each other to thereby narrow or widen the flow path. Representative examples of such choke valves are described in U.S. Pat. No. 5,018,703. In other known configurations, and in further attempts to reduce wear and adverse effect of pressure, flow may be directed in a radial manner and redirected by baffles as described in U.S. Pat. No. 6,105,614. However, as in the choke valves before, large pressure differentials are difficult to control with such known devices.

Pressure differences in high pressure oil and gas fields at early production are often estimated to be around 6000 psi or even higher, but then expected to substantially decrease over time. Such anticipated pressure gradient is difficult to manage in a safe and economic manner using currently known technology. Among other reasons, current production chokes may have a flow coefficient Cv of 1 GPM*psi$^{-0.5}$ when the choke is at or near closed position, which corresponds to a rate of 3000 BBLs per day liquid rate. However, the well will require a very high Cv in later production to compensate for the much lower well pressure. Therefore, the ideal choke valve should have a low Cv in beginning of well production and a high Cv in late well production to allow for sufficient production control without costly intervention or choke replacement.

Unfortunately, while wide range Cv valves were suggested, commercially and technically feasible wide range Cv valves have not been developed.

To overcome such problems with a wide range of Cv, it was proposed to employ a topside choke in combination with a subsea choke. While the combination of a subsea production choke in combination with a topside choke advantageously provides a widened control of Cv, numerous new difficulties arise. For example, such configurations require high-pressure flowlines boarding the production vessel, which presents a significant risk during equipment failure. Alternatively, it was also proposed that a second choke could be mounted on the production deck or at the subsea riser base. While such configurations would reduce severity of service conditions at the chokes, subsea flowlines must then accommodate high pressure, adding risk and capital cost to the project. Worse yet, in case of equipment failure, substantial hazards to platform and personnel nearby or on the production deck may exist. Still further, elevated pressure in the flowlines will pose substantial challenges for flow assurance due to higher risk of hydrates formation and plugging.

Multiple choke configurations are known for downhole applications in which each of the chokes is separately controlled and in which the chokes are arranged in parallel as described in U.S. Pat. App. No. 2007/0163774. Control systems for such downhole multi-choke devices is typically in electrohydraulic manner as described in WO 99/47788. However, the chokes in such configurations are predominantly used to isolate areas within a well, for example, to reduce or prevent water intake in a production line. Consequently, such chokes will operate in an on/off manner and typically not allow for flow control.

Therefore, while numerous configurations and methods of production well control are known in the art, all or almost all of them suffer from one or more disadvantages. Thus, there is still a need to provide improved configurations and methods of production well control.

SUMMARY OF THE INVENTION

The present invention is directed to configurations and methods of production control for subsea wells, and especially for high pressure subsea wells. In preferred aspects, at least two production chokes are fluidly and serially coupled to the wellhead, wherein at least one of the production chokes is coupled to the production tree. Thus, contemplated configurations advantageously allow substantial pressure reduction over a wide range of pressure at a wide range of flow coefficients.

In one aspect of the inventive subject matter, a subsea production assembly includes a first production choke that is fluidly and in series coupled to a second production choke, wherein the first production choke reduces pressure of a hydrocarbon stream from a subsea well from well pressure to a reduced pressure, and wherein the second production choke reduces pressure of the hydrocarbon stream from the reduced pressure to a riser pressure. Most preferably, the first and second production chokes are fluidly coupled to a wellhead in a position at or downstream of the wellhead and upstream of a riser base.

Depending on the particular production requirements, the first and second production chokes may be coupled to a production tree, or the first production choke is coupled to a production tree, while the second production choke is coupled to a subsea pipeline-end device (e.g., PLEM, PLET), a well jumper, or a flowline jumper. Most typically, the configurations contemplated herein are particularly advantageous where the difference between well pressure and riser pressure is greater than 4500 psi or 5500 psi, and even higher. Thus, it should be appreciated that the pressure difference between the inlets of the first and second subsea production chokes (and between the inlet of the second choke and the riser) is less than 4000 psi, and more typically less than 2500 psi, and so significantly reduces wear on the production chokes. As a further advantage, it should be recognized that contemplated configurations will provide a combined range of Cv of between 1.2 and 0.05 GPM*psi$^{-0.5}$, and more typically between 1.0 and 0.1 GPM*psi$^{-0.5}$.

Consequently, and in another aspect of the inventive subject matter, a method of controlling a hydrocarbon product flow in a subsea location comprises a step of fluidly coupling to a wellhead a first and a second production choke in a position at or downstream of the wellhead and upstream of a riser base, wherein the first production choke is configured to reduce pressure of the hydrocarbon product flow from a subsea well from a well pressure to a reduced pressure, and wherein the second production choke is configured to reduce pressure of the hydrocarbon product flow from the reduced pressure to a riser pressure. With respect to particular configurations and advantages of such methods, the same considerations as provided for the subsea assembly above apply.

Various objects, features, aspects and advantages of the present invention will become more apparent from the following detailed description of preferred embodiments of the invention.

BRIEF DESCRIPTION OF THE DRAWING

FIG. 1 schematically depicts exemplary subsea production assembly according to the inventive subject matter.

DETAILED DESCRIPTION

The inventor has now discovered that effective production well control of high pressure (HP) wells can be achieved in a relatively simple and economic manner in which two (or even more) subsea production chokes are located near a wellhead. It should be noted that the production chokes contemplated herein expressly exclude downhole chokes. Most preferably, the first and second subsea production chokes are operated in series such that the pressure difference between the wellhead and the riser is split across at least two chokes. Therefore, even in high pressure wells with a wellhead pressure in excess of 5000 psi, the pressure differential across each of the choke valves is significantly reduced.

Consequently, it should be appreciated that the flow conditions for the choke trims in such configurations are greatly improved, thus substantially prolonging the service life of the production chokes. Moreover, the pressure in the flowline during operation is significantly lower when compared with configurations using a subsea choke and a topside choke. Thus, the risk for hydrates plugs to form in the flowlines is substantially reduced. Viewed from a different perspective, contemplated configurations and methods allow for production choke assemblies that have an unusually wide flow coefficient range, which is particularly desirable where well pressure is initially very high and then declines to moderate and even low levels.

These and other advantages will improve economics (e.g., due to reduced intervention replacing chokes), production time, and further reduce risk to personnel and equipment in case of failure. It should also be particularly noted that contemplated configurations with two subsea chokes in series will not require dedicated or new technology, but may employ current choke technology. Moreover, use of sequential subsea production chokes, especially where operated at or in proximity to the wellhead will facilitate operation throughout the entire production life of a subsea well.

Therefore, in especially preferred configurations, subsea production assembly will include a first production choke that is fluidly and in series coupled to a second production choke. Most typically, the first production choke is configured to reduce the pressure of the hydrocarbon stream from at or about well pressure to a reduced pressure, and the second production choke is configured to further reduce pressure of the hydrocarbon stream from the reduced pressure to the riser pressure. In further particularly preferred aspects, the first and the second production chokes are fluidly coupled to the wellhead in a position at or downstream of the wellhead, but upstream of a riser base. As used herein, the term "about" in conjunction with a numeral refers to a range of that numeral starting from 20% below the absolute of the numeral to 20% above the absolute of the numeral, inclusive. For example, the term "about 5000 psig" refers to a range of 4000 psig to 6000 psig.

While it is generally contemplated that the position of the first and second production chokes may vary considerably, it is preferred that the chokes are mounted on devices that are located at the seabed. Thus, and among other options, it is contemplated that the first choke is mounted on the production tree. The second choke can then be mounted in series with the first choke on the same tree and downstream of the first choke to receive the stream that is reduced in pressure. Alternatively, the second choke may also be mounted in a position upstream of a riser, and most preferably upstream of a riser base. Therefore, suitable locations of the second production choke include the production manifold, the flowline end template/manifold (FLEM). However, even more preferred locations include the tree, the well jumper, a flowline jumper, and/or a pipeline end devices (e.g., pipeline end termination (PLET) or a pipeline end manifold (PLEM)).

With respect to the choice of first and second production chokes parameters, it should be appreciated that the particular set of parameters will generally depend on the specific well condition. However, it is generally contemplated that the first and second production chokes are selected such that the pressure difference between the wellhead pressure and the riser pressure is about equally split. For example, where the well head pressure is about 6000 psi and the riser pressure is about 1000 psi, it is contemplated that the first production choke is configured to reduce the pressure from 6000 psi to about 3500 psi, and that the second choke is configured to reduce the pressure from about 3500 psi to about 1000 psi. However, it should be appreciated that more than two serially operating chokes may also be implemented. Also, it is contemplated that the pressure difference need not be split in half, and numerous other pressure differences are also deemed suitable. For example, using the example above, it is contemplated that the first production choke is configured to reduce the pressure from 6000 psi to about 4500 psi, and that the second choke is configured to reduce the pressure from about 4500 psi to about 1000 psi.

Typically, the difference between the well pressure and the riser pressure is greater than 3000 psi, more typically greater than 4500 psi, and most typically greater than 5500 psi. Therefore, contemplated pressure differences between the inlets of the first and second subsea production chokes are typically less than 4000 psi, and even more typically less than 2500 psi. Depending on the particular choke configuration well pressure, and riser pressure, it is generally preferred that first and second production chokes are selected such that the flow coefficient of the choke combination is between 1.5 and 0.01 GPM*psi$^{-0.5}$, more preferably between 1.2 and 0.05 GPM*psi$^{-0.5}$, and most preferably between 1.0 and 0.1 GPM*psi$^{-0.5}$.

In still further contemplated aspects, a first back-up choke may be implemented that is fluidly and in parallel coupled to the first production choke, and a second back-up choke may be implemented that is fluidly and in parallel coupled to the second production choke. In such configurations, one of the production chokes may be operated while the other can be replaced or otherwise serviced.

It should be especially recognized that all known and commercially available subsea production chokes are deemed suitable for use herein, and the particular choice of a choke will predominantly depend on the production volume and pressure. Therefore, suitable production chokes include those in which disk stacks provide a tortuous path for the product, those in which a series of concentric sleeves define flow paths, and especially those designed to exhibit improved wear resistance over prolonged periods of operation. Operation of the production chokes is preferably performed using well known manners in the art, and therefore include hydraulic, pneumatic, and electric actuation, all of which are preferably controlled by a topside computer or other command platform.

FIG. 1 depicts an exemplary subsea production assembly 100 in which a first production choke 110 is fluidly and in series coupled to a second production choke 120, wherein both production chokes are non-downhole production chokes and are fluidly coupled to a wellhead 102 of a production well 130 in a position at or downstream of the wellhead 102 and upstream of a riser base 140. The first and second production chokes are typically coupled to a production tree 104, however, the first production choke 110 may also be coupled to a production tree 104, while the second production choke 120 may be coupled to a subsea pipeline-end device 106 (e.g., a pipeline end manifold).

Consequently, a method of controlling flow of a hydrocarbon product in a subsea location comprises a step of fluidly coupling to a wellhead a first and a second production choke in a position at or downstream of the wellhead and upstream of a riser base, wherein the first production choke is configured to reduce pressure of the hydrocarbon product flow from a subsea well from a well pressure to a reduced pressure, and wherein the second production choke is configured to reduce pressure of the hydrocarbon product flow from the reduced pressure to a riser pressure. Most preferably, first and second production chokes are coupled to a production tree, or the second production choke is coupled to a device selected from the group consisting of a subsea pipeline-end device, a well jumper, or a flowline jumper. With respect to further configurations and aspects, the same considerations as provided above apply.

Thus, specific embodiments and applications of HP production have been disclosed. It should be apparent, however, to those skilled in the art that many more modifications besides those already described are possible without departing from the inventive concepts herein. The inventive subject matter, therefore, is not to be restricted except in the spirit of the present disclosure. Moreover, in interpreting the specification and contemplated claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. Furthermore, where a definition or use of a term in a reference, which is incorporated by reference herein is inconsistent or contrary to the definition of that term provided herein, the definition of that term provided herein applies and the definition of that term in the reference does not apply.

What is claimed is:

1. A subsea production assembly comprising:

a first production choke fluidly and in series coupled to a second production choke to control flow of a hydrocarbon production stream from a well, wherein the first and second production chokes are non-downhole production chokes, and wherein the hydrocarbon production stream flows through the first and second production chokes;

wherein the first production choke is configured to reduce pressure of the hydrocarbon production stream from a subsea well from a well pressure to a reduced pressure;

wherein the second production choke is configured to reduce pressure of the hydrocarbon stream from the reduced pressure to a riser pressure;

wherein first and second production chokes are fluidly coupled to a wellhead in a position at or downstream of the wellhead and upstream of a riser base; and wherein the wellhead is configured to produce a high pressure fluid.

2. The subsea production assembly of claim 1 wherein first and second production chokes are coupled to a production tree.

3. The subsea production assembly of claim 1 wherein the first production choke is coupled to a production tree, and wherein the second production choke is coupled to a device selected from the group consisting of a subsea pipeline-end device, a well jumper, and a flowline jumper.

4. The subsea production assembly of claim 3 wherein the subsea pipeline-end device is a pipeline end termination or a pipeline end manifold.

5. The subsea production assembly of claim 1 wherein a difference between the well pressure and the riser pressure is greater than 4500 psi.

6. The subsea production assembly of claim 1 wherein a difference between the well pressure and the riser pressure is greater than 5500 psi.

7. The subsea production assembly of claim 1 wherein a pressure difference between inlets of the first and second subsea production chokes is less than 4000 psi.

8. The subsea production assembly of claim 1 wherein a pressure difference between inlets of the first and second subsea production chokes is less than 2500 psi.

9. The subsea production assembly of claim 1 wherein the first and second subsea production chokes have a combined range of Cv of between 1.2 and 0.05 GPM*psi$^{0.5}$.

10. The subsea production assembly of claim 1 wherein the first and second subsea production chokes have a combined range of Cv of between 1.0 and 0.1 GPM*psi$^{0.5}$.

11. A method of controlling a hydrocarbon product flow in a subsea location comprising:

fluidly coupling to a wellhead a first and a second production choke to control flow of a hydrocarbon production stream from a subsea well in a position at or downstream of the wellhead and upstream of a riser base, wherein the first and second production chokes are non-downhole production chokes, and wherein the hydrocarbon production stream flows through the first and second production chokes;

wherein the wellhead is configured to produce a high pressure fluid;

wherein the first production choke is configured to reduce pressure of the hydrocarbon production stream from the subsea well from a well pressure to a reduced pressure; and wherein the second production choke is configured to reduce pressure of the hydrocarbon production stream from the reduced pressure to a riser pressure.

12. The method of claim 11 wherein first and second production chokes are coupled to a production tree.

13. The method of claim 11 wherein the first production choke is coupled to a production tree, and wherein the second production choke is coupled to a device selected from the group consisting of a subsea pipeline-end device, a well jumper, and a flowline jumper.

14. The method of claim 13 wherein the subsea pipeline-end device is a pipeline end termination or a pipeline end manifold.

15. The method of claim 11 wherein a difference between the well pressure and the riser pressure is greater than 4500 psi.

16. The method of claim 11 wherein a difference between the well pressure and the riser pressure is greater than 5500 psi.

17. The method of claim 11 wherein a pressure difference between inlets of the first and second subsea production chokes is less than 4000 psi.

18. The method of claim 11 wherein a pressure difference between inlets of the first and second subsea production chokes is less than 2500 psi.

19. The method of claim 11 wherein the first and second subsea production chokes have a combined range of Cv of between 1.2 and 0.05 $GPM*psi^{0.5}$.

20. The method of claim 11 wherein the first and second subsea production chokes have a combined range of Cv of between 1.0 and 0.1 $GPM*psi^{0.5}$.

* * * * *